US006935048B2

(12) United States Patent
Park et al.

(10) Patent No.: US 6,935,048 B2
(45) Date of Patent: Aug. 30, 2005

(54) DEVICE FOR SUPPORTING BURNER AND DRYER WITH THE SAME

(75) Inventors: Soo Won Park, Changwon-shi (KR); Kyoung Soo Kim, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/415,494

(22) PCT Filed: Sep. 4, 2002

(86) PCT No.: PCT/KR02/01678

§ 371 (c)(1),
(2), (4) Date: Apr. 30, 2003

(87) PCT Pub. No.: WO03/021029

PCT Pub. Date: Mar. 13, 2003

(65) Prior Publication Data

US 2004/0058291 A1 Mar. 25, 2004

(30) Foreign Application Priority Data

Sep. 5, 2001 (KR) ..... 2001-54535

(51) Int. Cl.[7] ..... D06F 58/26

(52) U.S. Cl. ..... 34/132; 34/595; 34/139; 431/354

(58) Field of Search ..... 34/130, 132, 595, 34/139; 432/105, 117; 431/354

(56) References Cited

U.S. PATENT DOCUMENTS

| | | | | |
|---|---|---|---|---|
| 3,238,636 A | | 3/1966 | Chafee, Jr. et al. | |
| 3,291,467 A | * | 12/1966 | Erickson | 432/105 |
| 3,826,607 A | | 7/1974 | Kuhn | |
| 5,468,145 A | * | 11/1995 | Ferlin | 431/266 |

* cited by examiner

*Primary Examiner*—Jiping Lu
(74) *Attorney, Agent, or Firm*—McKenna Long & Aldridge LLP

(57) ABSTRACT

A device for supporting a burner (20) and a dryer having the same are disclosed, in which a structure for supporting the burner is simplified, thereby decreasing the manufacturing price and fabricating of the device is easy. The device for supporting the burner includes a base (70), a burner generating a hot air, a support member (60) having a main connecting part provided between the base and the burner for being detachably inserted to the base so as to support the burner.

20 Claims, 4 Drawing Sheets

DEVICE FOR SUPPORTING BURNER AND DRYER WITH THE SAME

TECHNICAL FIELD

The present invention relates to a dryer, and more particularly, to a device for supporting a burner producing heated air to dry the laundry and a dryer with the same.

BACKGROUND ART

In general, a dryer is a device of drying the laundry by use of hot and damp air, and includes a burner for producing the hot and damp air, i.e., heated air.

FIG. 1 is an exploded perspective view of a conventional dryer, and FIG. 2 is a cross sectional view of a conventional burner supporting device for a dryer.

As shown in FIG. 1, the dryer includes a drum 1 having a cabinet (not shown) forming its appearance and receiving an object to be dried therein. The drum 1 has a cylindrical shape with both ends thereof opened, and is rotated by a separate driving unit (not shown). To this end, the drum 1 is provided at an outer periphery thereof with a belt groove 2, which a driving belt (not shown) is wound on the belt groove. Also, the drum 1 is provided at an inner periphery thereof with a baffle 1*a* for tumbling the object to be dried during a rotation.

The drum 1 is provided at both opened ends thereof with a front head 3 and a rear head 5, respectively. A sealant 6 is interposed between the front head 3 and the drum 1 and between the rear head 5 and the drum 1 for prevent the leakage. The front head 3 is formed with a through-hole 4 for communicating the interior and exterior of the drum 1, and the through-hole 4 is selectively opened/closed by a door (not shown). An outlet assembly 11 is installed in a channel, through which the air is discharged from the drum 1, located under the through-hole 4 of the front head 3. The outlet assembly 11 is provided at a front thereof with a lint filter 12 for filtering out small, fine particles from the discharged air.

Also, the outlet assembly 11 is provided at the front thereof with a lint duct 13 accommodating the lint filter 12 therein and communicated with the outlet assembly 11. A blower 14 is installed at a rear of the lint duct 13. The blower 14 is to compulsorily discharge the air from the interior of the drum 1. The blower 14 is installed in a blower housing 15, and the blower housing 15 is communicated with the lint duct 13 and coupled to a discharge pipe 16 toward the exterior. The air in the drum 1 is discharged to the exterior through the outlet assembly 1, the lint duct 13, the blower housing 15 and the discharge pipe 16, by turns.

An air supply duct 17 is installed at a rear of the rear head 5, and a heated-air duct 18 is located under the air supply duct 17. The air supply duct 17 and the heated-air duct 18 serve as a role of supplying the heated air into the drum 1. To this end, a burner 20 is provided at the front of the heated-air duct 18.

The burner 20 includes a burner body 21 for injecting supplied gas, and a mixing pipe 22 extending from the burner body 21 to the interior of the heated-air duct 18. The burner body 21 is connected to a gas supply pipe 24, and has a valve (not shown) for controlling the supply of the gas. The mixing pipe 22 is to mix the gas injected from the burner body 21 with the air. The mixing pipe 22 is provided at a front end thereof with a spark plug 23 for igniting the burner.

The structure of supporting the burner 20 will now be described with reference to FIG. 2.

As shown in FIG. 2, a bottom surface of the cabinet or a separate base 30 has a '⊏'-shaped support portion 40 for supporting the burner 20. The burner 20 is supported on the support portion 40, with the mixing pipe 22 seating on an upper surface of the support portion 40. Fastening flanges 41 are extended from both ends of the support portion 40, and are coupled to the base 30. The fastening flange 41 is rigidly secured to the base by separate fastening screws 42.

The conventional structure of supporting the burner 20 has a following problem.

In order to secure the support portion 40 to the base 30, it is required for a number of fastening screws 42. It causes the number of components to be increased, thereby increasing the manufacturing cost. In addition, the individually fastening operation of the fastening screws 42 results in the increased number of the assembling operation, thereby significantly reducing the assembling productivity.

DISCLOSURE OF THE INVENTION

Accordingly, the present invention is directed to a device for supporting a burner that substantially obviates one or more of the problems due to limitations and disadvantages of the related art.

An object of the present invention is to provide a device for supporting a burner capable of simplifying the structure, thereby reducing a production cost and improving assembly work.

Another object of the present invention is to provide a dryer having the above burner supporting device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, there is provided a device for supporting a burner, the device comprising: a base; a burner for producing heated air; and a supporting member installed between the base and the burner for supporting the burner and having a main coupling portion detachably fitted to the base.

The supporting member further has an auxiliary coupling portion fastened to base by a fastening screw. The supporting member consists of a support portion supporting a bottom surface of the burner, and a flange extended parallel with the base from an end of the support portion and forming the main coupling portion and the auxiliary coupling portion.

The base has a latch member, to which the main coupling portion is inserted, and an engaging hole for receiving the fasten screw. At that time, a latch hole is formed at the main coupling portion, and a latch boss is formed at the latch member and inserted to the latch hole when the main coupling portion is inserted to the latch member.

The latch member is integrally formed with the base, in other words, is formed by cutting and bending the base. The latch member is formed at a position corresponding to each of both corners of the main coupling portion, and has a triangular inserting groove corresponding to the corner of the main coupling portion.

The device further comprises a burner base interposed between the burner and the supporting member, on which the burner is seated. The burner base has a body guide supporting the burner body, and a pipe seating portion supporting a mixing pipe of the burner. The pipe seating portion is provided with a seating channel having a curvature corresponding to a shape of the mixing pipe.

According to another aspect of the present invention, there is provided a dryer comprising: a cabinet; a drum rotatably installed in an interior of the cabinet and receiving an object to be dried therein; a burner installed in the interior of the cabinet for producing heated air; an air duct for guiding the heated air produced by the burner into the drum; and a supporting member installed between a bottom surface of the cabinet and the burner for supporting the burner, and having a main coupling portion detachably fitted to the cabinet and an auxiliary coupling portion fastened to the cabinet by a fasten screw.

With the structure of the present invention, the supporting member is sufficiently supported by the bottom surface of the base or cabinet by only the process of inserting the main coupling portion to the latch member. Accordingly, it may reduce the number of fasten screws, thereby reducing a production cost and reduce a process of assembling operation, thereby improving assembly work.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to a preferred embodiment of the present invention, examples of which are illustrated in the accompanying drawings.

Figure 3:
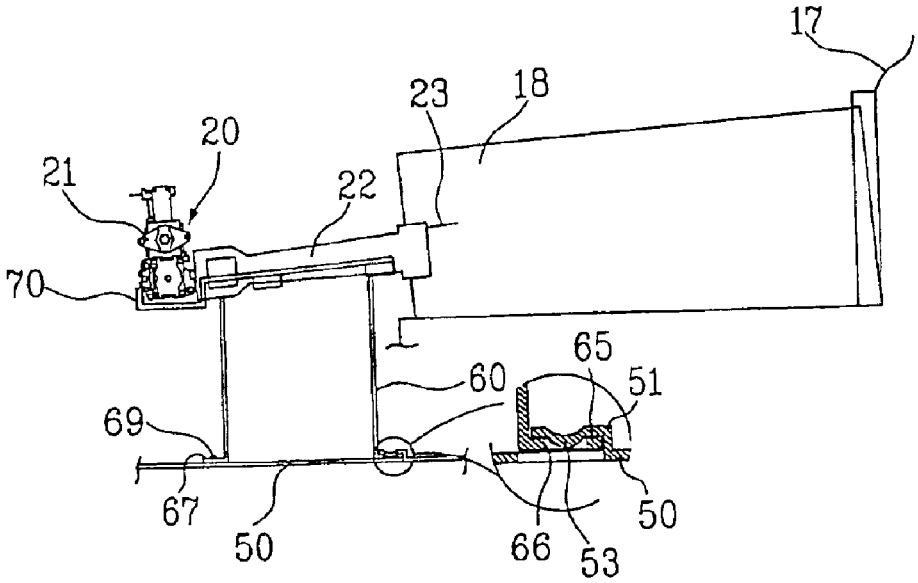
FIG. 3 is a cross sectional view of a burner supporting device for a dryer according to the present invention.
Figure 4:
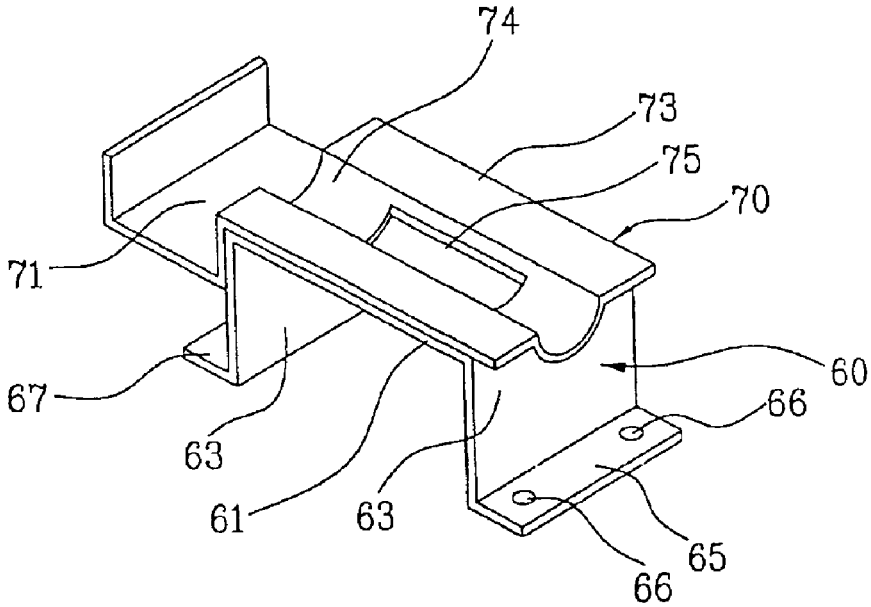
FIG. 4 is a perspective view for showing a burner base and a supporting member of a burner supporting device according to the present invention.
Figure 5:
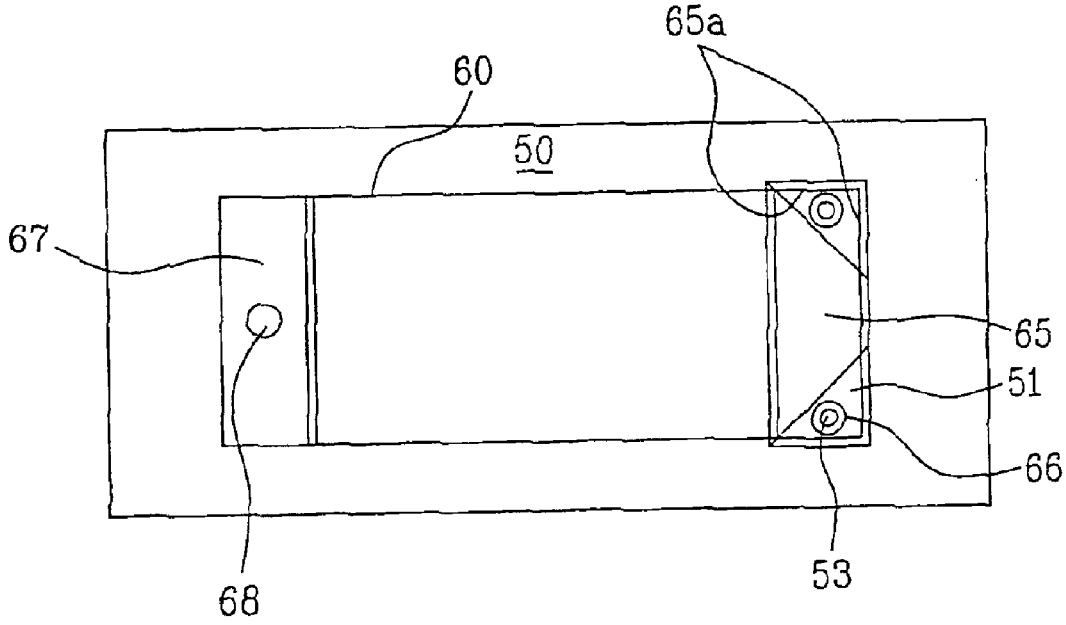
FIG. 5 is a plan view of a burner supporting device according to the present invention, in which a supporting member is mounted on a base.

FIG. 3 is a cross sectional view of a burner supporting device for a dryer according to the present invention, FIG. 4 is a perspective view for showing a burner base and a supporting member of the burner supporting device according to the present invention, and FIG. 5 is a plan view of the burner supporting device according to the present invention, in which the supporting member is mounted on the base.

Figure 1:
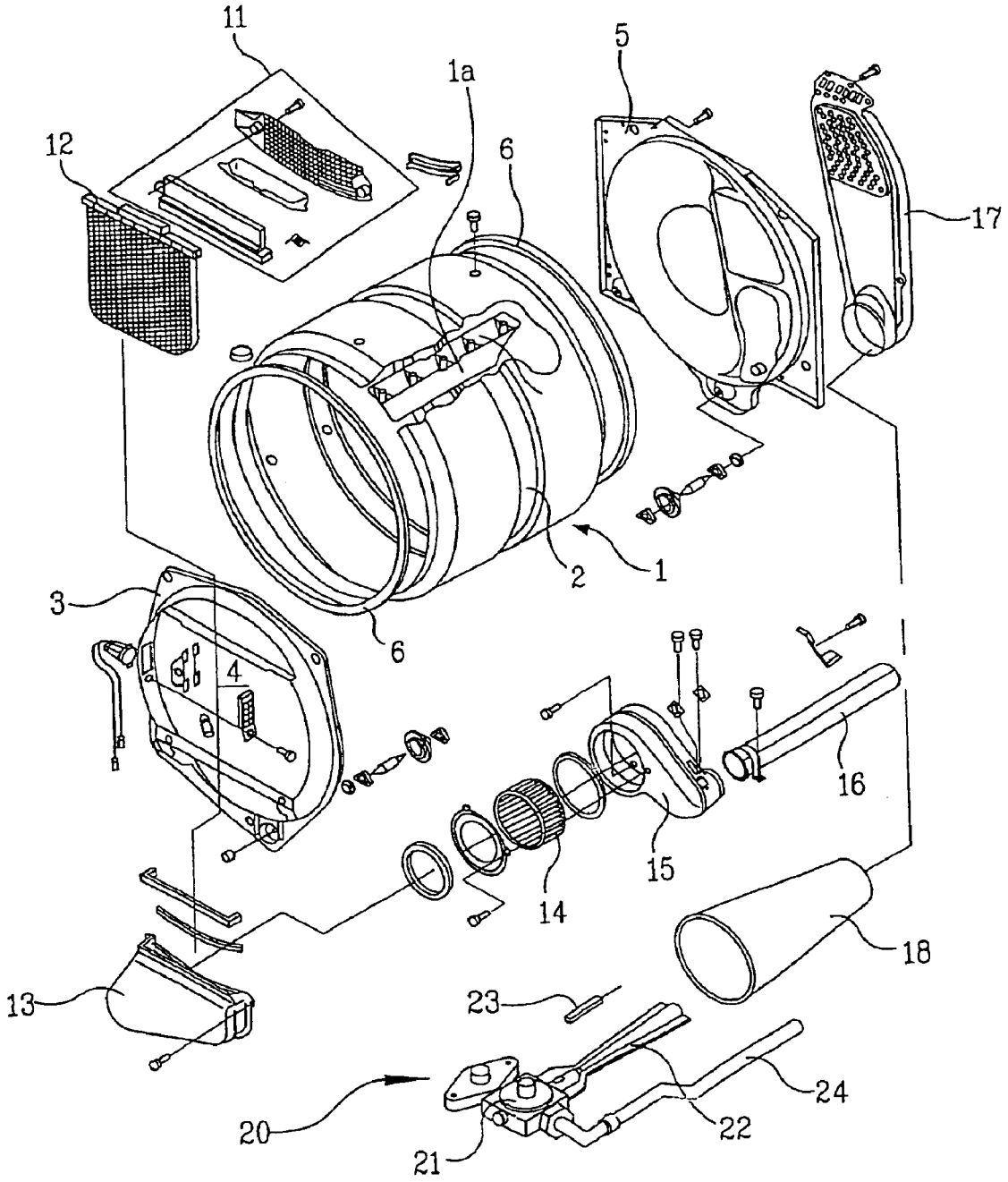
FIG.1 Related Art
FIG. 1 is an exploded perspective view of a conventional dryer.
Figure 2:
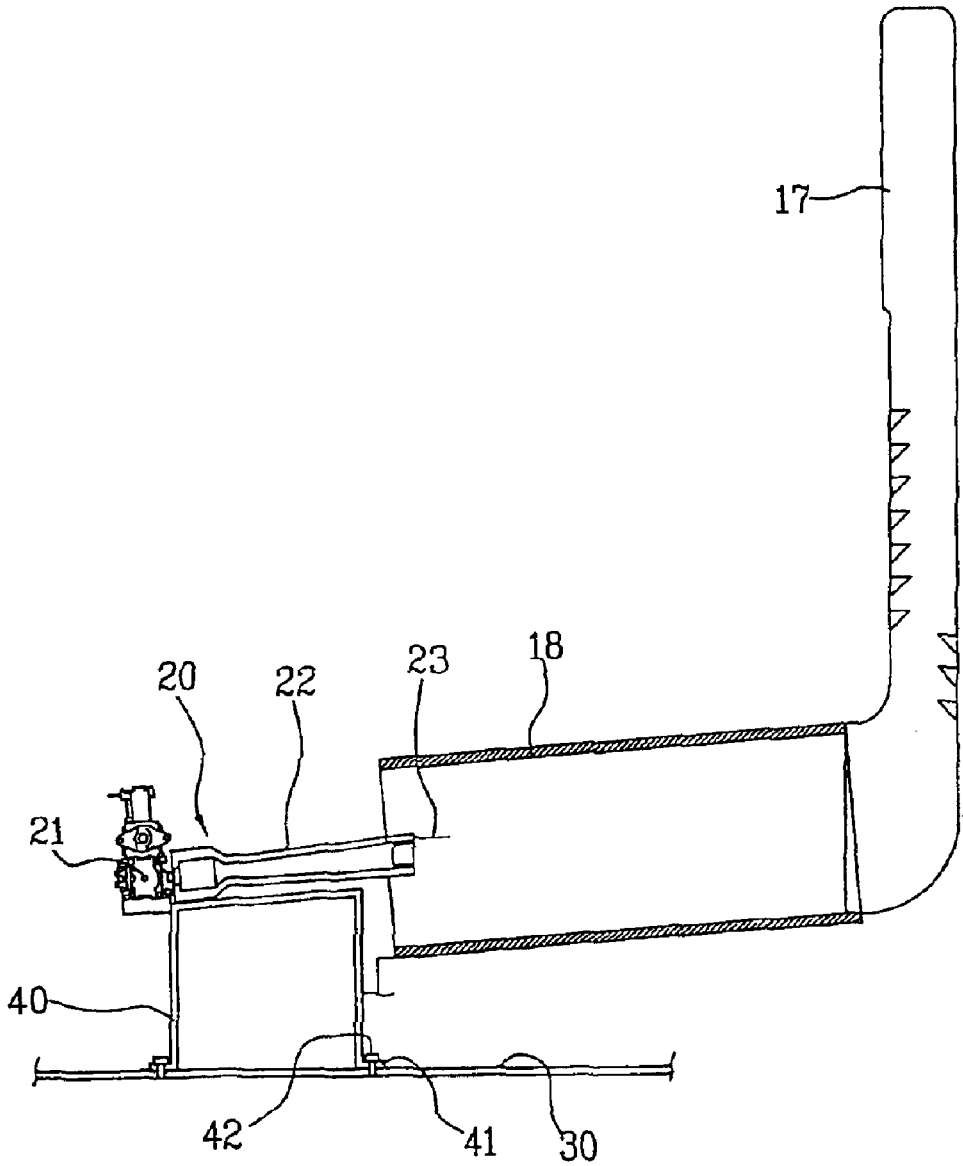
FIG. 2 Related Art
FIG. 2 is a cross sectional view of a conventional burner supporting device for a dryer.

In advance of the description, the burner supporting device hereinafter is a part of the dryer shown in FIG. 1. The burner supporting device according to the present invention may be applied to any apparatus having a burner, for example, a combined laundry washing/drying machine, as well as a dryer.

As shown in FIG. 3, a burner 20 is provided on a bottom surface of a cabinet 50 for producing heated air. The burner 20 is a gas burner, and includes a burner body 21 for injecting supplied gas, and a mixing pipe 22 extending from the burner body 21 to the interior of the heated air duct 18. The burner body 21 is connected to a gas supply pipe 24 (see FIG. 1), and has a valve (not shown) for controlling the supply of the gas. The mixing pipe 22 is to mix the gas injected from the burner body 21 with the air. The mixing pipe 22 is provided at a front end thereof with a spark plug 23 for igniting the burner.

The heated air duct 18 is connected to an air supply duct 17 communicated with the drum. In case flame is formed at the leading end, the heated air is produced in the heated-air duct 18, and is supplied to the interior of the drum through the air supply duct 17.

The burner 20 is supported on the bottom surface of the cabinet 50 by a supporting member 60. The supporting member 60 includes, as shown in FIG. 4, '⊏'-shaped support portions 61 and 63, and fastening flanges 65 and 67 extended parallel with the bottom surface of the cabinet 50 from an end of the support portion.

The support portion has an upper plate 61 having a desired area and supporting a bottom surface of the burner 20, and side plates 63 bent toward the bottom surface of the cabinet 50 from the upper plate 61. The upper plate 61 may be formed in such a manner that it is inclined upward toward the heated-air duct 18 according to a design condition of the mixing pipe 22. The fastening flanges 65 and 67 are extended ends of the side plate 63, respectively.

The right fastening flange 65 of the fastening flanges shown in figures is a main coupling portion, while the left fastening flange 67 is an auxiliary coupling portion. The main coupling portion 65 is a portion detachable to the bottom surface of the cabinet 50, while the auxiliary coupling portion 67 is a portion secured to the bottom surface of the cabinet 50 by a fastening screw 69. To this end, the auxiliary coupling portion 67 is formed with an engaging hole 68 receiving the fastening screw 67 (referring to FIG. 5).

The cabinet 50 is provided at the bottom surface thereof with a latch member 51, to which the main coupling portion 65 is inserted, so that the main coupling portion 65 may be fastened to the cabinet 50. The latch member 51 is formed by cutting and bending the cabinet 50, and has an approximately '⊓' shape. The main coupling portion 65 is formed with a latch hole 66, and a latch boss 53 protruded under the latch member 51. When the main coupling portion 65 is inserted to the interior of the latch member 51, the latch boss 53 is inserted to the latch hole 66. The latch boss 53 and the latch hole 66 are to strong the coupling force of the main coupling portion 65.

The latch hole 66 of the main coupling portion 65 and the engaging hole 68 of the auxiliary coupling portion 67 have the same inner diameter. This is to utilize the same tool upon boring the engaging hole 68 and the latch hole 66. At that time, since the boring work may be achieved without altering the tool, the work efficiency is improved.

As shown in FIG. 5, the latch member 51 is formed at a position corresponding to each of both corners of the main coupling portion 65. The latch member 51 has a triangular inserting groove corresponding to the corner of the main coupling portion 65, when viewing at the top. In addition, the latch boss 53 is formed at a center of the latch member 51. When the main coupling portion 51 is inserted to the latching member 51, both edges 65*a* of the main coupling portion adjacent to the corner of the main coupling portion 65 are supported by an inner wall of the latch member 61. Whatever the main coupling portion 65 is applied with force of any direction, the latch member 65 more rigidly supports the main coupling portion 65.

As shown in FIG. 4, a burner base 70 is interposed between the burner 20 and the supporting member 60. The burner base 70 is seated on the upper plate 61 of the supporting member to support the burner 20. Specifically, The burner base 70 includes a body guide 71 supporting the burner body 21, and a pipe seating portion 73 supporting the mixing pipe 22. The body guide 71 is protruded from the upper plate 61, and the pipe seating portion 73 is seated on the upper plate 61. The pipe seating portion 73 is provided with a seating channel 74 having a curvature corresponding to the mixing pipe 22 of the burner 20. The seating channel 74 is formed with a through-hole 75 penetrating the pipe seating portion 73.

The assembling process of the burner supporting device according to the present invention will now be described.

As shown in FIG. 3, the supporting member 60 is coupled to the bottom surface of the cabinet 50, and the burner 20 is seated on the supporting member 60, with the burner base 70 interposed between the burner and the supporting member.

Describing the procedures in order, after the main coupling portion 65 of the supporting member 60 is inserted to the latch member 51, the auxiliary coupling portion 67 is coupled to the cabinet 50. Specifically, if the main coupling portion 65 is fully inserted to the latch member 51, it seems to be a pre-assembled condition that the latch boss 53 is seated in the latch hole 66. At that time, the engaging hole 68 of the auxiliary coupling portion 67 naturally corresponds to the engaging hole of the cabinet 50. After that, by fastening the fastening screw 69 to the engaging hole 68, the supporting member 60 is fully coupled to the cabinet 50. This state is shown in FIG. 5. The main coupling portion 65 is inserted to the triangular latch member 51. In this case, the latch member 51 restricts the movements of the supporting member 60, so that the supporting member 60 may not move in any direction.

And then, the pipe seating portion 73 of the burner base 70 is seated on the upper plate 61 of the supporting member 60, and the burner 20 is seated on the burner base 70. At that time, the burner body 21 is seated on the body guide 71, and the mixing pipe 22 is seated on the pipe seating portion 73. According to that the mixing pipe 22 is seated in a recessed groove, i.e., the seating channel 74, the burner 20 is rigidly supported by the burner base 70.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The burner supporting device and the dryer with the same according to the present invention has an effect as following.

The supporting member of the present invention includes the main coupling portion inserted to the cabinet, and the auxiliary coupling portion fastened to the cabinet by the fasten screw. Specifically, the main coupling portion is inserted to the latch member of the cabinet, while the auxiliary coupling portion is fastened to the cabinet by the fasten screw.

Accordingly, the present invention may reduce the number of fasten screws, thereby reducing a production cost and reduce a process of assembling operation, thereby improving assembly work.

The present invention may rigidly couple the supporting member to the cabinet by use of the main coupling portion and the auxiliary coupling portion.

What is claimed is:

1. A device for supporting a burner, the device comprising:

a base;

a burner for producing heated air; and a supporting member installed between the base and the burner for supporting the burner and having a main coupling and an auxiliary coupling fastened to the base by a fastening screw, wherein the main coupling is detachably inserted into the base.

2. The device as claimed in claim 1, wherein the supporting member has a support portion supporting a bottom surface of the burner, and a flange extending parallel with the base from an end of the support portion and forming the main coupling and the auxiliary coupling.

3. The device as claimed in claim 2, wherein the base has a latch member, to which the main coupling is inserted, and an engaging hole for receiving the fastening screw.

4. The device as claimed in claim 3, wherein the latch member is formed by cutting and bending the base.

5. The device as claimed in claim 3, wherein the supporting member has a latch hole formed at the main coupling, and a latch boss formed at the latch member and inserted to the latch hole when the main coupling is inserted to the latch member.

6. The device as claimed in claim 5, wherein the latch hole of the main coupling and the engaging hole of the auxiliary coupling have a same inner diameter.

7. The device as claimed in claim 3, wherein the latch member is formed at a position corresponding to each of both corners of the main coupling, and has a triangular inserting groove corresponding to the corner of the main coupling.

8. The device as claimed in claim 1, further comprising a burner base interposed between the burner and the supporting member, on which the burner is seated.

9. The device as claimed in claim 8, wherein the burner base has a body guide supporting the burner body, and a pipe seating portion supporting a mixing pipe of the burner.

10. The device as claimed in claim 9, wherein the pipe seating portion is provided with a seating channel having a curvature corresponding to a shape of the mixing pipe.

11. A dryer comprising:

a cabinet;

a drum rotatably installed in an interior of the cabinet and receiving an object to be dried therein;

a burner installed in the interior of the cabinet for producing heated air;

an air duct for guiding the heated air produced by the burner into the drum; and a supporting member installed between a bottom surface of the cabinet and the burner for supporting the burner, and having a main coupling portion detachably fitted to the cabinet and an auxiliary coupling portion fastened to the cabinet by a fastening screw.

12. The dryer as claimed in claim 11, wherein the supporting member has a support portion supporting a bottom surface of the burner, and a flange extending parallel with the base from an end of the support portion and forming the main coupling portion and the auxiliary coupling portion.

13. The dryer as claimed in claim 12, wherein the cabinet has a latch member, to which the main coupling portion is inserted, and an engaging hole for receiving the fastening screw.

14. The dryer as claimed in claim 13, wherein the latch member is formed by cutting and bending the cabinet.

15. The dryer as claimed in claim 13, wherein the supporting member has a latch hole formed at the main coupling portion, and a latch boss formed at the latch member and inserted to the latch hole when the main coupling portion is inserted to the latch member.

16. The dryer as claimed in claim 15, wherein the latch hole of the main coupling portion and the engaging hole of the auxiliary coupling portion have a same inner diameter.

17. The device as claimed in claim 13, wherein the latch member is formed at a position corresponding to each of both corners of the main coupling portion, and has a triangular inserting groove corresponding to the corner of the main coupling portion.

18. The device as claimed in claim 11, further comprising a burner base interposed between the burner and the supporting member, on which the burner is seated.

19. The device as claimed in claim 18, wherein the burner base has a body guide supporting the burner body, and a pipe seating portion supporting a mixing pipe of the burner.

20. A device for supporting a burner, the device comprising:

a base having an engaging hole;

a burner for producing heated air; and a supporting member installed between the base and the burner for supporting the burner, the supporting member having a main coupling and an auxiliary coupling fastened to the base by a fastening screw, wherein the main coupling is inserted into the engaging hole.

* * * * *